United States Patent [19]

Büttner et al.

[11] Patent Number: 4,783,816

[45] Date of Patent: Nov. 8, 1988

[54] HEARING AID TO BE WORN BEHIND THE EAR HAVING BATTERY AND VOLUME CONTROL FACING IN OPPOSITE DIRECTIONS

[75] Inventors: Gerhard Büttner, Grossenseebach; Berndt Diefenbach, Percha, both of Fed. Rep. of Germany

[73] Assignee: Siemens Aktiengesellschaft, Berlin and Munich, Fed. Rep. of Germany

[21] Appl. No.: 714,337

[22] Filed: Mar. 21, 1985

[30] Foreign Application Priority Data

Sep. 27, 1984 [DE] Fed. Rep. of Germany ... 8428516[U]

[51] Int. Cl.[4] ..... H04R 25/00

[52] U.S. Cl. ..... 381/68.7; 381/69.2

[58] Field of Search ..... 179/107 H, 107 R, 179; 381/68, 69, 68.7, 69.2; 181/129, 130

[56] References Cited

U.S. PATENT DOCUMENTS

| | | | |
|---|---|---|---|
| 3,031,537 | 4/1962 | Rose | 381/68.7 |
| 3,035,127 | 5/1962 | Strzalkowski | 381/23.1 |
| 3,045,073 | 7/1962 | Vickerson | 381/68.7 |
| 3,138,491 | 6/1964 | Rabio | 381/69.2 |
| 3,209,080 | 9/1965 | Güttner et al. | 381/68.7 |
| 3,749,853 | 7/1973 | Ely et al. | 381/68.7 |
| 3,828,142 | 8/1974 | Büttner | 381/69 |
| 4,354,065 | 10/1982 | Buettner | 381/68.7 |

FOREIGN PATENT DOCUMENTS

| | | | |
|---|---|---|---|
| 1139549 | 11/1962 | Fed. Rep. of Germany . | |
| 1153797 | 9/1963 | Fed. Rep. of Germany . | |
| 7518682 | 6/1975 | Fed. Rep. of Germany . | |
| 3245030 | 6/1984 | Fed. Rep. of Germany | 381/68 |
| 1068022 | 5/1967 | United Kingdom | 381/68 |

OTHER PUBLICATIONS

Electronic Engineering, "An Integrated Circuit Hearing Aid", vol. 37, p. 101, Feb. 1965.

*Primary Examiner*—Jin F. Ng
*Assistant Examiner*—Danita R. Byrd
*Attorney, Agent, or Firm*—Mark H. Jay

[57] ABSTRACT

A hearing aid of the type which is worn behind the ear has a battery compartment and a volume control knob at its lower end. The compartment and knob are at right angles to the longitudinal axis of the device.

6 Claims, 2 Drawing Sheets

HEARING AID TO BE WORN BEHIND THE EAR HAVING BATTERY AND VOLUME CONTROL FACING IN OPPOSITE DIRECTIONS

BACKGROUND OF THE INVENTION

The invention relates to a hearing aid of the type which is worn behind the ear.

Because these devices must fit into the space available behind the ear, a space-saving arrangement of the structural elements is important. Further, the controls for the device should be easy to operate.

One object of the invention is to provide a hearing aid which can fit behind the ear.

Another object is to provide such a hearing aid in which the controls are easy to operate.

A further object is to provide such a hearing aid in which the setting of the volume control can easily be checked.

SUMMARY OF THE INVENTION

In accordance with the invention, the bulky parts of the hearing aid are placed at the ends of the housing, and the parts that can be well distributed, between the ends. The form of the device is therefore well-adapted to the space existing behind the ear.

In further accordance with the invention, the volume actuator is rotated 90° with respect to the longitudinal axis of the housing at the lower end of the housing, and the entire rotary actuator is brought to the surface of the housing. Thus it is easy to grip and can be set in a simple manner. In addition, this actuator may be provided on its smooth surface with a feelable marking, the position of which can be determined by touching the actuator. It has been found desirable to establish, for volume control, a rotation of the actuator by 270°.

The housing is advantageously made of two shells which abut along a joint extending along the lateral walls, so that one shell lies at the inner arc of the housing and the other at the outer arc of the housing. The two shells can be colored differently to give the device a more elegant appearance, for those who wish to wear the device inconspicuously.

To adapt shells of different color to a particular user's preference, it is further desirable to be able to change the color especially of that shell that lies at the outer arc, for instance by changing the shell that happens to be installed for one that has the desired color. To this end a detachable connection of the two shells, as by plug or screw connections, is suitable.

At the upper end of the housing end by which the hearing aid is hung on the ear, the sound transducers are lodged. This facilitates reception of the sound frontally with the microphone without any great losses and also makes it possible to convey the sound from the receiver to the auditory meatus by the shortest path. The two transducers are intalled in the usual manner in spaces which are separated by an intermediate plate. This plate may also serve as a base for an on-off switch by which the reception of signals can be switched from the microphone to an audio-coil.

The space between the transducers and the battery with the volume actuator is usable in known devices for accommodating the amplifier. Such an amplifier may be constructed as a multi-layer system. To be able to accomodate in the small space a maximum number of structural elements, it has proved desirable to use a three-layer system which, being provided with several bending zones, can be adapted especially well to the existing space.

The amplifier may also contain elements used for adjusting the frequency transmission curve and for dynamic range control (such as peak clipping). These should lie at the outer arc and be accessible through an opening of the housing shell closable for instance with a flap. The actuators may be combined with an audio-coil to form a unit which can be included in the construction of the amplifier.

At the lower end of the housing, i.e. the end opposite the suspension, there is a compartment accessible from the outside n which a battery may be lodged, for instance behind a flap. The volume control may be located parallel to and adjacent to the battery. The volume control is preferably fastened to the outer shell, because the actual mechanical actuator may then be a wheel located on the surface of the shell, being thus fully accessible. As feelable marking the actuator may have on its outer face a knob whose position can be felt when touching it. The knob may also be given a color different from its surroundings, so that the position of the volume control can also simply be seen.

A battery or storage battery may be lodged in the compartment next to the volume control. The compartment is closed for instance by a flap from the inner arc of the housing. For opening, a hinge is provided which lies crosswise to the longitudinal extent of the device at the end of the inner arc of the housing. Thus the current source can be replaced simply and quickly.

BRIEF DESCRIPTION OF THE DRAWINGS

Exemplary and non-limiting preferred embodiments of the invention are shown in the drawings, in which.

DETAILED DESCRIPTION OF PREFERRED EMBODIMENTS

Figure 1:
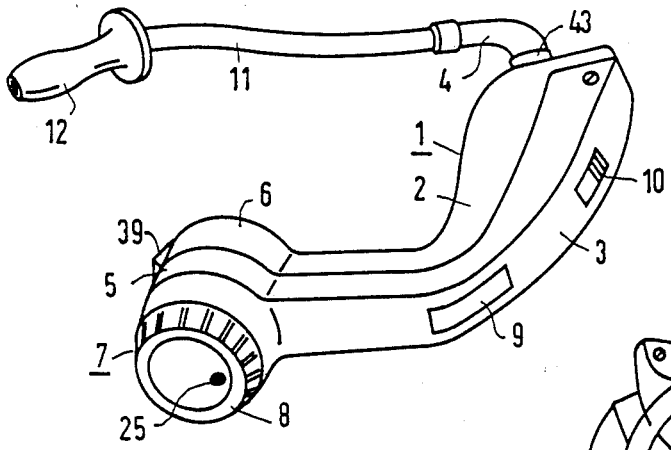
FIG. 1 is a perspective view of the preferred embodiment.

In FIG. 1, 1 generally denotes the housing of the preferred embodiment. The housing 1 consists of a curved shell 2 open to the outside and of a shell 3 open to the inside. The two shells are placed together with their open sides facing each other, thus forming the housing 1.

At the upper end of the housing 1 is a wearing hook 4, and at the opposite lower end a compartment 5 for a battery (not shown). This compartment 5 is closed with a cover 6, which can be opened toward the inside of the curved housing 1. Toward the outside on compartment 5 is a volume control 7, operable by its setting wheel 8. The outer arc of shell 3 has a cap 9 approximately at its center and, between the cap 9 and the upper end, a switch 10. At the end of the wearing hook 4, which contains a sound duct 22 (FIG. 6), a tube 11 is connected which opens into an elastic earpiece 12 that connects the device to the auditory meatus of its user.

Figure 2:
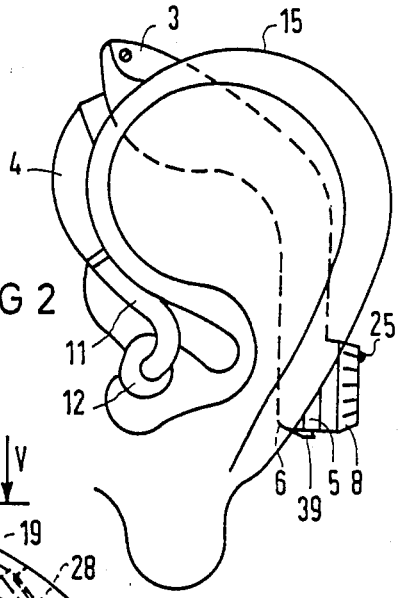
FIG. 2 shows the arrangement of the preferred embodiment at the ear.
Figure 3:
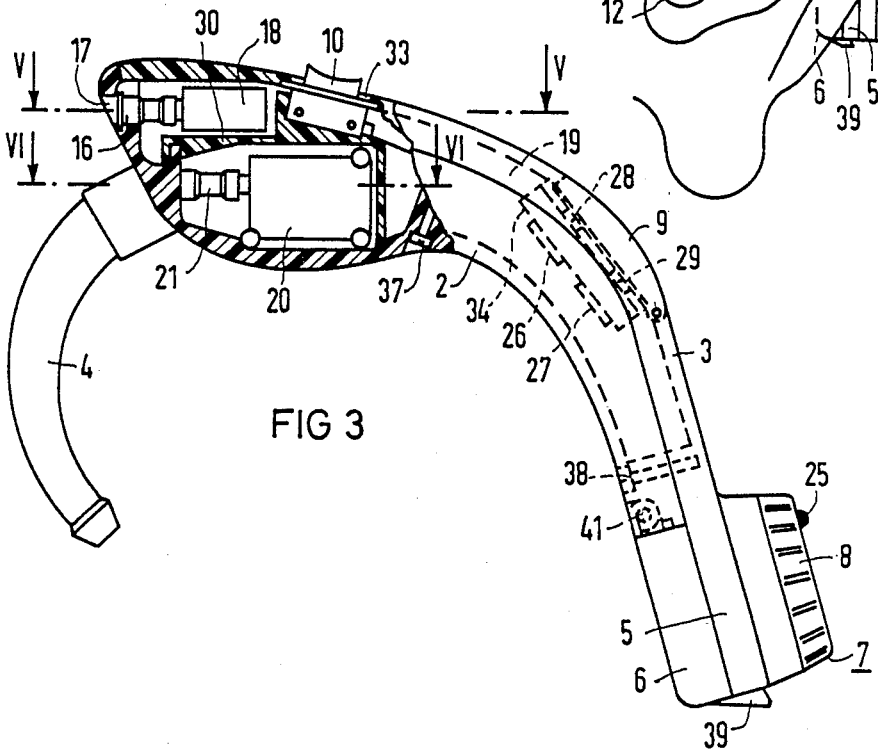
FIG. 3 shows a side view of the preferred embodiment, partially broken open.
Figure 6:
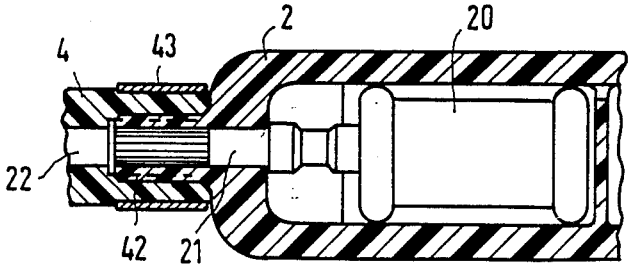
FIG. 6 shows the top view of a section along line VI—VI in FIG. 3.

As shown in FIG. 2, the device is hung on the ear 15 in such a way that its inner arc abuts the back of the root of the ear. At the top of the pinna the device is retained by the hook 4. As shown in FIG. 3, sound reaches a microphone 18 through an opening 17 in the front face 16. The sound is transformed there into electrical signals, amplified in an amplifier 19 located in the central portion of housing 1, and finally supplied to a receiver 20. Thence the sound obtained from the amplified signals passes through a line 21 into the sound duct 22 in hook 4 (FIG. 6). The amplifier 19 is supplied with energy by the battery lodged in case 5.

The sound volume reaching the ear 15 is adjusted by rotation of the setting wheel 8. The setting of this wheel is visible from the position of a knob 25 (which is colored differently from its surroundings) and can also be felt because knob 25 is raised above the surface of wheel 8.

The amplifier 19 can be adjusted by controls 26 and 27. The controls can be adjusted by knobs 28, 29, to vary the transmitted frequency and the effect of very high acoustic intensities by adjusting the peak clipping.

Figure 5:
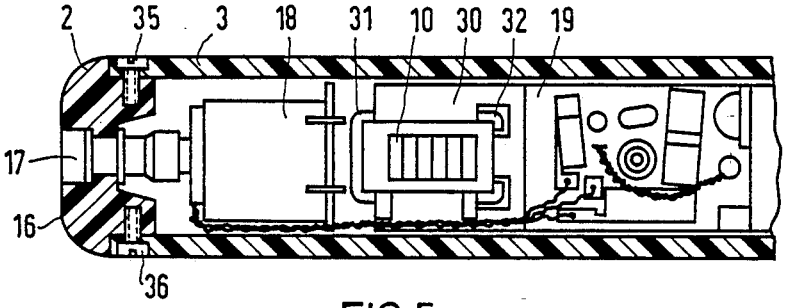
FIG. 5 shows a section along line V—V in FIG. 3.

The switch 10 is located, as can be seen from FIG. 5, on a plate 30, where it is fastened in suitable mounts 31, 32 and in the opening 33 of shell 3. The switch 10 serves as an on-off switch and for switching the signal reception between the microphone 18 and an inductance coil 34, which is combined with the controls 26 and 27 to form a structural unit.

The two shells 2 and 3 are detachably joined together, as by screws 35 to 38, so that the upper shell 3 can be exchanged. It can be chosen for instance to have a different color than the lower shell 2.

Figure 4:
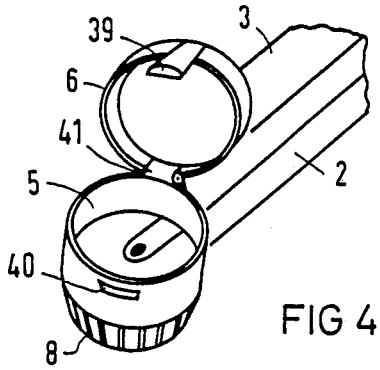
FIG. 4 shows in perspective oblique view, the end of the preferred embodiment in which the battery is to be installed.

The battery lodged in compartment 5 can be replaced after cover 6 has been opened. The cover 6 itself is adapted to be snapped on at a depression 40 by means of a snap lug 38 at its outer end (FIG. 4). At its opposite end the cover 6 is pivotably mounted at the lower end of shell 2 in a hinge 41.

At a threaded shoulder 42 the wearing hook 4 is screwed to the upper end face of shell 2 of housing 1. Its bore, i.e. the sound duct 22, is provided at this end wtih a female thread at its housing-side end. To compensate for the weakening of hook 4 resulting from this cutout, a metal ring 43 is applied over the outside of the screw connection.

Those skilled in the art will understand that changes can be made in the preferred embodiments here described, and that these embodiments can be used for other purposes. Such changes and uses are within the scope of the invention, which is limited only by the claims which follow.

What is claimed is:

1. A hearing aid for use behind the ear comprising:

a housing with top and bottom ends and having an inner surface, an outer surface and two side surfaces;

a hook located at the top end of the housing;

a battery compartment located at the bottom end of the housing; and a volume control located at said bottom end adjacent and parallel to said battery compartment wherein the battery compartment is mounted on the inner surface of the housing and the volume control is mounted on the outer surface of the housing.

2. The hearing aid of claim 1 wherein the volume control further comprises a control knob which operatively connected thereto.

3. The hearing aid of claim 1, wherein said housing comprises two shells which are detachably secured to each other.

4. The hearing aid of claim 1, further comprising: an access port on the housing located intermediate said ends;

an amplifier contained in the housing intermediate said ends; and an inductance coil and controls for adjustment of frequency response and dynamic range operatively connected to said amplifier, said coil and controls being accessible through said access port.

5. The hearing aid of claim 1, further comprising:

a plate secured inside the housing adjacent said top end;

a receiver located beneath said plate;

a microphone located along said plate; and a switch mount mounted to said plate for receiving an externally-accessible switch.

6. The hearing aid of claim 2, wherein the knob has a raised surface which is sufficiently rough that a user can distinguish a position of the knob by touching it.

* * * * *